United States Patent [19]

Harvey et al.

[11] Patent Number: 4,798,263

[45] Date of Patent: Jan. 17, 1989

[54] LADDER STABILIZER

[75] Inventors: David H. C. Harvey, Poynings; Ian G. Menelaus, Burgess Hill, both of Great Britain

[73] Assignee: Stabilad Limited, Burgess Hill, England

[21] Appl. No.: 52,789

[22] Filed: May 21, 1987

[30] Foreign Application Priority Data

Oct. 2, 1986 [GB] United Kingdom ..... 8623702

[51] Int. Cl.[4] ..... E06C 5/36; E06C 7/42

[52] U.S. Cl. ..... 182/107; 182/172

[58] Field of Search ..... 182/107, 108, 214, 230, 182/204, 172

[56] References Cited

U.S. PATENT DOCUMENTS

| | | | |
|---|---|---|---|
| 1,352,566 | 9/1920 | Voll | 182/107 |
| 1,398,851 | 11/1921 | Garven | 248/211 |
| 2,419,065 | 4/1947 | Fowler | 182/107 |
| 4,194,592 | 3/1980 | Evans | 182/214 |

FOREIGN PATENT DOCUMENTS

| | | | |
|---|---|---|---|
| 1024706 | 1/1953 | France | 182/107 |
| 415170 | 8/1934 | United Kingdom | 182/107 |
| 2166793 | 5/1986 | United Kingdom | 182/107 |

*Primary Examiner*—Reinaldo P. Machado

*Attorney, Agent, or Firm*—Chilton, Alix & Van Kirk

[57] ABSTRACT

A stabilizer device for attachment to a ladder, comprising an attachment portion adapted to be attached to a stile of a ladder and a leg portion connected to and extending away from the attachment portion, the attachment portion being provided with two projections of adjustable length extending outwardly therefrom and positioned such that the stile can pass freely therebetween when the axis of the stile, the projections, and a line joining the projections are generally mutually perpendicular, and such that the projections engage the respective edge faces of the stile when the device is rotated about an axis generally parallel to the rungs of the ladder. The device can be in the form of a ladder anchor for preventing the bottom of the ladder from slipping, or in the form of a ladder stay for holding the top of the ladder away from a wall.

13 Claims, 6 Drawing Sheets

LADDER STABILIZER

The present invention relates to an accessory for a ladder. More particularly it relates to a device for stabilising a ladder thereby improving the safety of the ladder user.

Many building, decorating and repair jobs require the use of a ladder but it is often found that the ideal conditions for ladder use are not available. Most ladders have only two small points of contact with the ground, at the base of each stile, and it is therefore essential that the ground line is entirely level and unyielding. Uneven or soft ground can allow the ladder to slip, and it is particularly dangerous if the base of the ladder slips outwards away from the wall. Even on hard, level ground the base of the ladder can slip outwards if its angle to the vertical is greater than 20°–30° and it is usually recommended that the distance of the ladder foot from the wall or other vertical surface should be as near as possible to one quarter of the height reached by the top of the ladder. Such safety requirements impose severe limitations on the situations where the safe use of a ladder is possible and tends to invite the use of unsafe practices.

The problems of safe ladder use are well appreciated and a number of safety devices are known in the art. These include simple boards on which the ladder is stood, having an upwardly directed lip to prevent outward movement of the ladder base, rope stays tied at one end to a ladder stile or rung and secured at the other end either to the vertical working surface or to a stake driven into the ground beneath the ladder, and a wide variety of permanent or detachable ladder feet. Such ladder feet may take the form of suction pads, simple serrated base plates or articulated feet intended to compensate for a slightly uneven ground line. None of these devices provides a perfect solution to the problem and most require either a fairly permanent attachment to the ladder or some form of adjustment and readjustment each time the ladder is moved.

Published British patent application No. 2166793 discloses a device comprising two brackets welded to the upper ends of respective box-section leg parts, interconnected at their lower ends by a rod, each bracket having two hook parts which engage the respective opposite edge faces of the ladder stiles. This type of ladder stabiliser is simple to attach and detach from the ladder. However, this device will safely fit only a single size and shape of ladder stile which necessitates its production in a number of designs and sizes in order to fit different types of ladder. This is a major disadvantage both for the manufacturer and retailer, who must deal with the problems and expense of several manufacturing lines, multiple packaging designs, and ordering and stocking a range of similar products, and for the final user who must purchase the correct size and design of stabiliser for the intended ladder use. Users may well have access to more than one type of ladder and may need separate stabilisers for each one. In addition, the prior device cannot be safely used on ladders with the ends of the rungs or other protrusions projecting from the outer side faces of the stiles. Such protrusions would restrict the available fitting positions of the device up and down the stile if the bracket fitted relatively closely to the stile or would allow unacceptable sideways movement if the bracket was sufficiently loose to allow it to pass over the protrusions. Furthermore, the rod connecting the lower ends of the two leg parts makes the device unwieldy and prevents the positioning of the legs at different levels, as may be desirable, for example, on very uneven ground or where one ladder stabiliser has to be placed at a higher level, such as on a step.

It is an object of the invention to provide a ladder stabiliser which can adjust itself to provide a secure engagement with the ground and the ladder in use, irrespective of the size and shape of the ladder stile or the presence of protrusions on the outer side face of the stile.

According to the present invention there is provided a stabiliser device for attachment to a ladder, comprising an attachment portion adapted to be attached to a stile of a ladder and a leg portion connected to and extending away from the attachment portion, the attachment portion being provided with two projections of adjustable length extending outwardly therefrom and positioned such that the stile can pass freely therebetween when the axis of the stile, the projections, and a line joining the projections are generally mutually perpendicular, and such that the projections engage the respective edge faces of the stile when the device is rotated about an axis generally parallel to the rungs of the ladder.

In this specification the 'sides' of a ladder are the directions to the left and right of a user standing on the ladder, so the side faces of the stiles are the faces normally intersected by the axes of the rungs. The front and rear of the ladder are the portions facing towards and away from the user respectively and the edge faces of the stiles are thus the front and rear faces of the stiles, which are generally perpendicular to the side faces. The invention is not limited to use with ladders having stiles of a rectangular cross-section: it may be used with virtually any cross-section including rounded sections in which the edge faces will be reduced to vertical lines along the stiles facing towards and away from the user.

The attachment and leg portions may be constructed of metal such as, for example, steel or aluminium alloy, or of moulded plastics or of composite materials, and preferably are an integral metal die casting. The projections may also be of metal or plastics material and are preferably of glass-filled nylon.

In one form of the invention, the device is an anchor for attachment to a ladder stile near the bottom of the ladder and operates such that forces on the ladder in use cause an increase in the force of engagement of the projections with the respective edge faces. In another form, the device is a ladder stay adapted to be attached to a ladder stile near the top of the ladder for holding the top of the ladder away from the wall. Again the force of the ladder on the device and the reaction of the wall on the device cause an increasing engagement between the projections and the edge faces of the stile.

The projections may take the form of short pieces of rod axially adjustably connected at one end to the attachment portion. They may have extensions at their opposite end, in a direction generally perpendicular to their longitudinal axis, to define a retaining means which can engage the inner side face of the stile to prevent the device from becoming detached during use.

In operation the adjustable projections allow the device to be attached to a ladder stile sufficiently firmly to provide safe support for the ladder, but the attachment does not prevent the device from sliding down the stile until the device firmly engages both the ground and the edge faces of the ladder stile. This provides great convenience in use, since the device may be fitted to the ladder above its desired position and then simply allowed to settle down to its final position. Thus, in the case of a ladder anchor, the retaining means are preferably sufficiently short to allow the device to pass up and down the stile without engaging the rungs for adjustment purposes immediately prior to the use of the attachment and to locate and adjust itself correctly upon contact of the leg portion with the ground. In the case of a ladder stay, at least one of the retaining means is preferably of such a length as to engage one of the rungs of the ladder to prevent the device from sliding down the ladder stile.

Each projection may be adjustably connected to the attachment portion by screwing one end thereof into a threaded hole in the attachment portion. Preferably, however, each projection comprises a pin which can be slidably fitted into a corresponding receiving hole in the attachment portion and clamped into position by any suitable fastening means. Such pins may be provided at one end with an eccentric head. Rotation of two such pins about their longitudinal axes within their respective receiving holes provides an adjustable retaining means, since cooperative rotation of said pins effectively alters the distance between the edges of the pin heads. At their maximum spacing the stabiliser device can be positioned onto the ladder stile without securely retaining it. The pins are then rotated to minimise the distance between the pin head edges and clamped into position thereby securely retaining the ladder stile between the two pins, the two pin heads and the attachment portion.

The inner face of the attachment portion which engages the outer side face of the ladder stile may be further provided with a relieved channel running generally transversely to a line joining the two projections. Preferably the recessed channel has a hollow dome region generally central to its longitudinal axis. The inner face of the attachment portion between and immediately adjacent to the two projections would lie in parallel contact with the outer side face of the ladder stile when the device is in use whilst the recessed channel may pass freely over any protrusions projecting from the approximate midline of the stile face. The central region of the inner face of the attachment portion may be the base of a generally hollow dome. The absence of material at this central region further aids in avoiding projections.

The leg portion connected to the attachment portion is preferably directed slightly outwardly in use so that the area enclosed by the four points of ground contact, i.e. the two ladder anchor feet and the two ladder stiles, is large, thus improving stability by increasing the moment required to tilt the ladder sideways.

The leg portion may be of uniform cross-section or may taper to provide a point to embed in soft ground or may provide a wider contact area with the ground if it is preferred that the leg should rest on the surface of the ground. Any known kind of ladder foot may be attached to the leg, such as friction or suction pads or an articulated foot.

The two ladder stabilisers for attachment to the respective stiles of a ladder are preferably mirror images of each other.

Some embodiments of the invention will now be described by way of example only and with reference to the accompanying drawings, in which.

Figure 1:
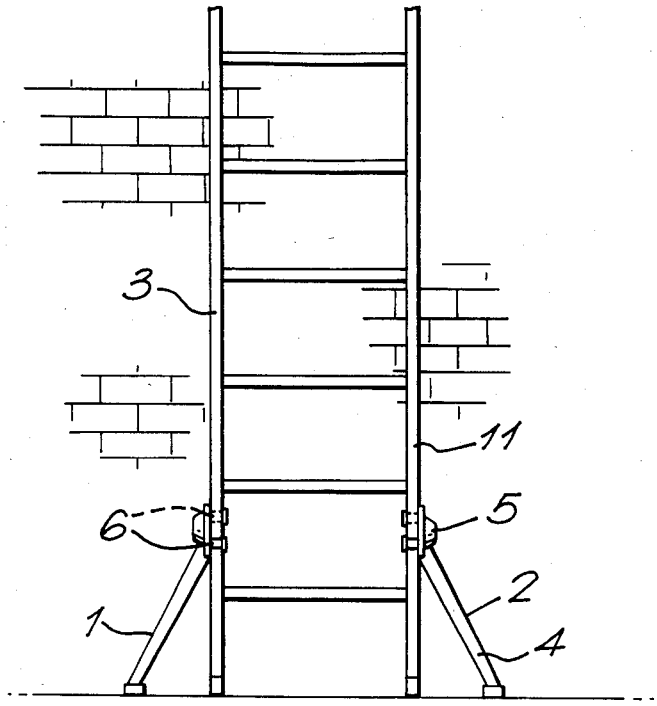
FIG. 1 is a front view of a pair of ladder anchors according to the invention attached to the stiles of a ladder.

Stabilisers 1 and 2 are intended to be used in pairs as shown in FIG. 1. Each pair comprises a left-hand stabiliser 1 for attachment to the left-hand ladder stile 3 and its mirror image comprising the right-hand stabiliser 2. Each stabiliser comprises an attachment portion 5 and a leg portion 4. The leg portion 4 of each stabiliser extends outwardly from the attachment portion 5 such that the distance between the two points of contact of the stabiliser legs with the ground is greater than the distance between the ladder stiles. This enhances the stabilising effect.

Each attachment portion is provided with two projections 6 which engage the opposite edge faces 10, 11 of the ladder stile when the device is attached thereto. In a preferred embodiment the attachment portion 5 and leg 4 are formed as an integral metal die casting whilst the projections 6 are of moulded plastics material such as, for example, glass-filled nylon.

Figure 2:
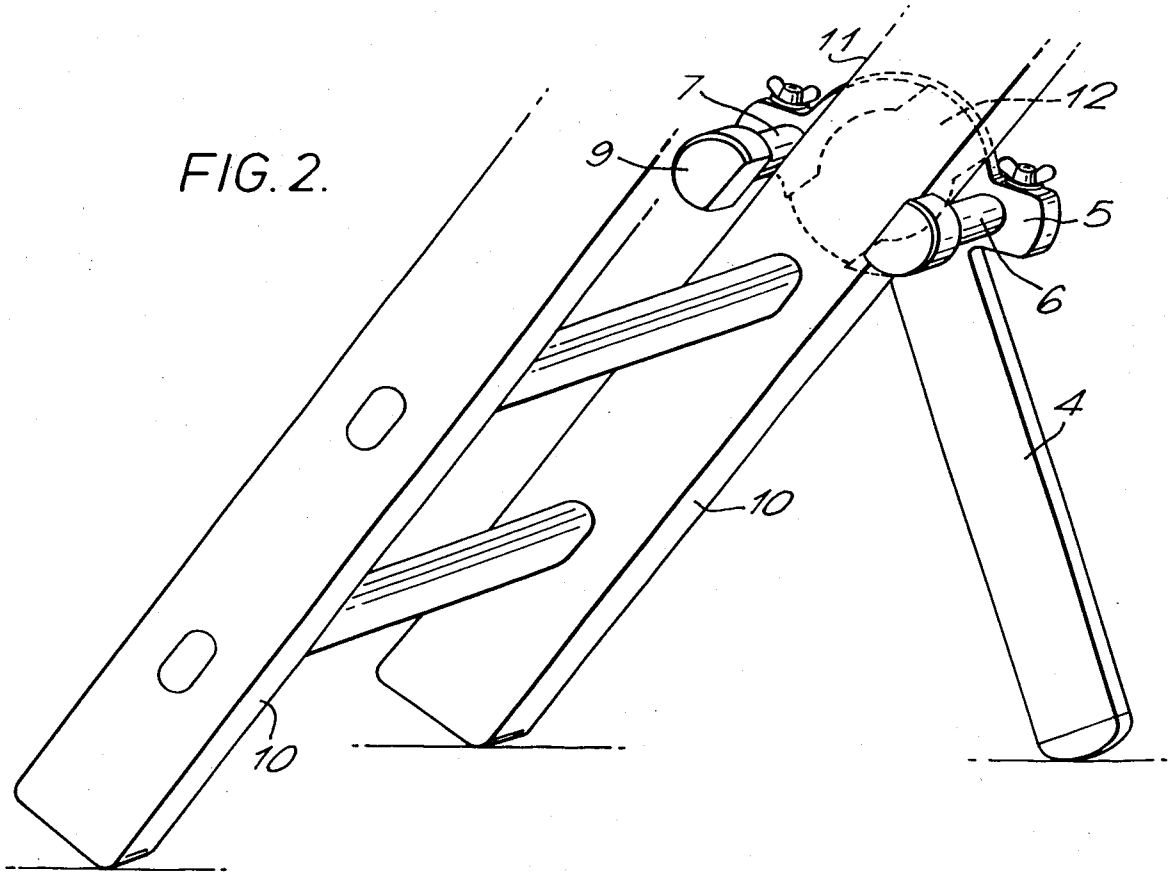
FIG. 2 is an inside perspective view of the left-hand ladder anchor of FIG. 1 during initial positioning onto the ladder stile.
Figure 3:
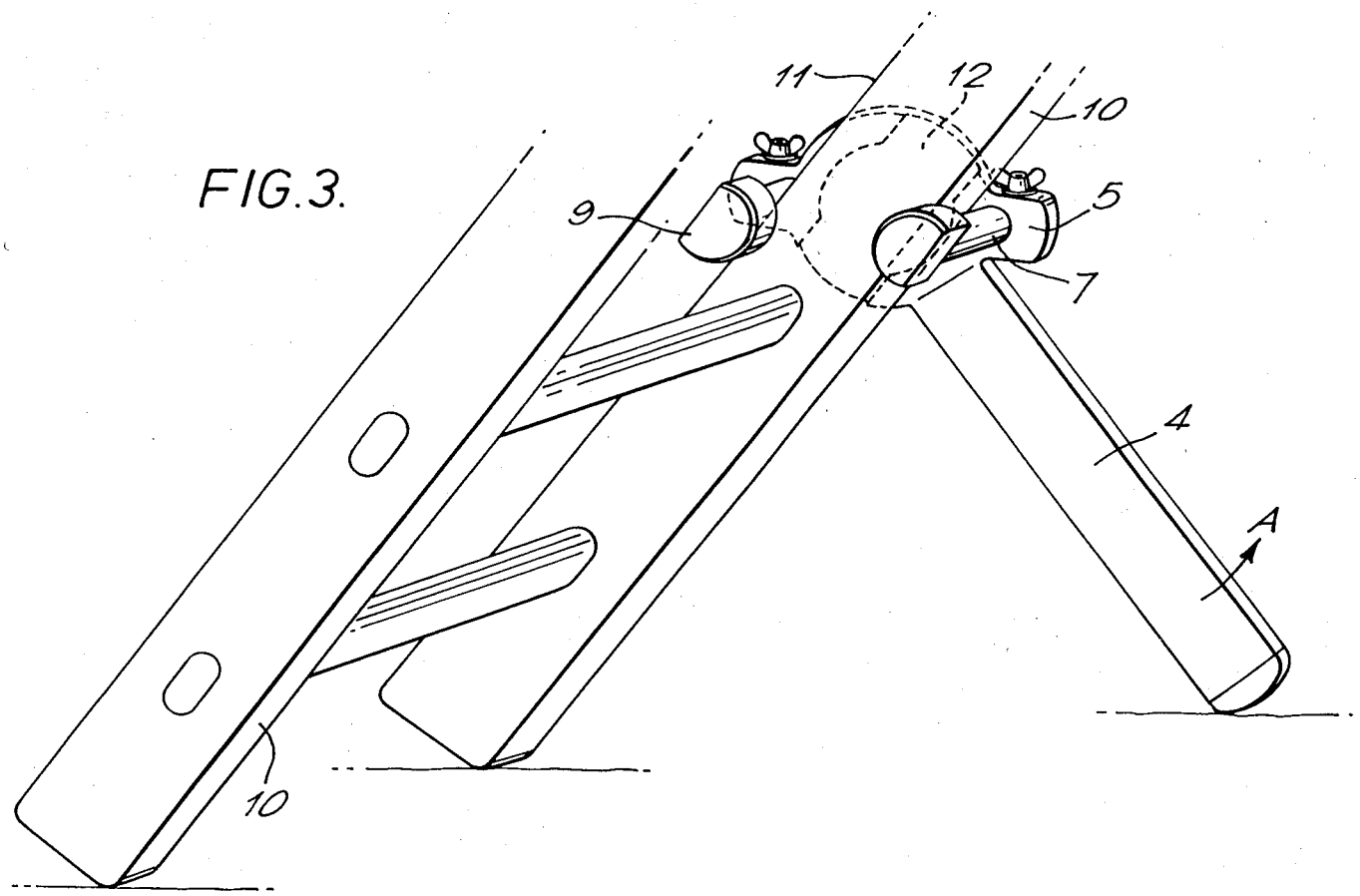
FIG. 3 is an inside perspective view of the ladder anchor of FIG. 2 securely attached to the ladder stile.

FIGS. 2 and 3 illustrate how the left-hand adjustable ladder stabiliser is attached to the ladder stile. In this preferred embodiment the two projections 6 comprise pins with cylindrical shafts 7 which fit slidably and rotatably into corresponding holes 17 within the attachment portion 5. The pins may be of solid design or may be hollow optionally with, for example, a number of interior reinforcing ribs extending radially from a central core for improved strength. Each pin is provided at one end with a D-shaped flattened head 9 which may be an integral part of the pin or separately manufactured and fastened to the pin shaft by any conventional means. The pins are rotated about their longitudinal axis such that the distance between the pin head edges is maximised and the stabiliser is initially positioned against the outer side face of the ladder stile as shown in FIG. 2. The pins are then rotated further so that the D-shaped heads partially enclose the ladder stile as shown in FIG. 3.

The pins are also adjustable along their longitudinal axis by a sliding motion guided within holes 17. Thus the effective length of the pin shaft protruding from the attachment head can be adjusted to be slightly longer, for example 1–2 mm longer, than the width of the stile edge 10, and the heads may be turned to enclose the stile, before the pins are clamped into position. The device is thereby securely attached to the ladder but remains sufficiently loose to slide freely on the stile so that it can adjust itself on contact with the ground whereupon the device is rotated slightly about an axis generally parallel to the rungs of the ladder, i.e. the leg is moved in the direction of the arrow A. This causes one pin shaft to engage the front edge face 11 of the ladder stile and the other to engage the rear edge face 10 of the stile. The end of the leg 4 engages the ground and if a load is subsequently placed on the ladder, or the ladder tends to slip, the reaction of the ground on the end of the leg tends to cause an increased rotation in the direction A resulting in an increased jamming effect of the projections 6 against the stile edge faces 10 and 11. The positioning of the flattened heads 9 adjacent to the inside face of the ladder stile prevents the device from becoming detached by moving sideways away from the ladder stile. A recessed channel 12 on the inner face of the attachment head allows freedom of movement even where protrusions are present on the outer side face of the stile, such as rivets or the ends of the rungs.

Figure 4:
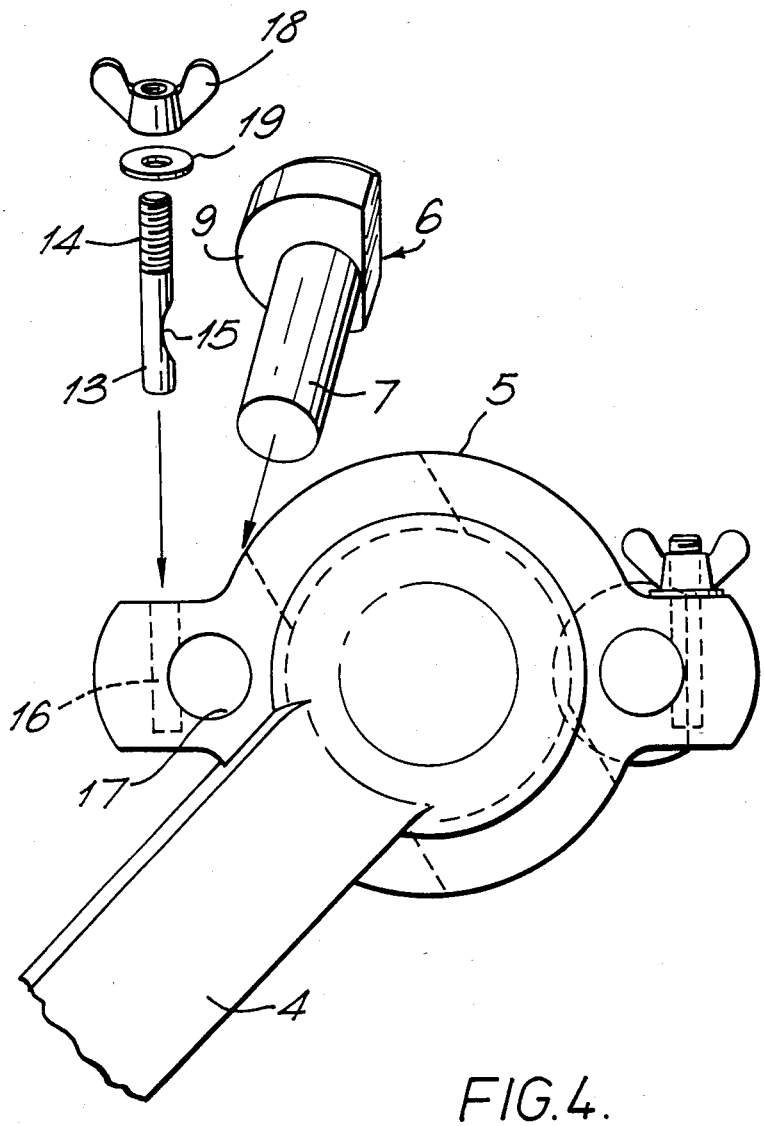
FIG. 4 is a side view of the attachment portion of the anchor of FIGS. 2 and 3 exploded to show the insertion of a pin and pad bolt.

FIG. 4 shows more clearly the attachment portion of a preferred embodiment of the invention. The preferred clamping mechanism comprises a pad bolt 13 having a threaded region at one end 14 and a cut-away radius 15 of a diameter corresponding to the diameter of the pin shaft 7. The pad bolt 13 fits into a blind cylindrical bore 16 in the attachment portion 5 and the pin shaft 7 is then fitted into the perpendicular cylindrical receiving hole 17. The pin is clamped into position by screwing a wing nut 18 and washer 19 onto the threaded region of the pad bolt which pulls the pad bolt in a direction generally perpendicular to the longitudinal axis of the pin and fastens the pad bolt in position.

Figure 5:
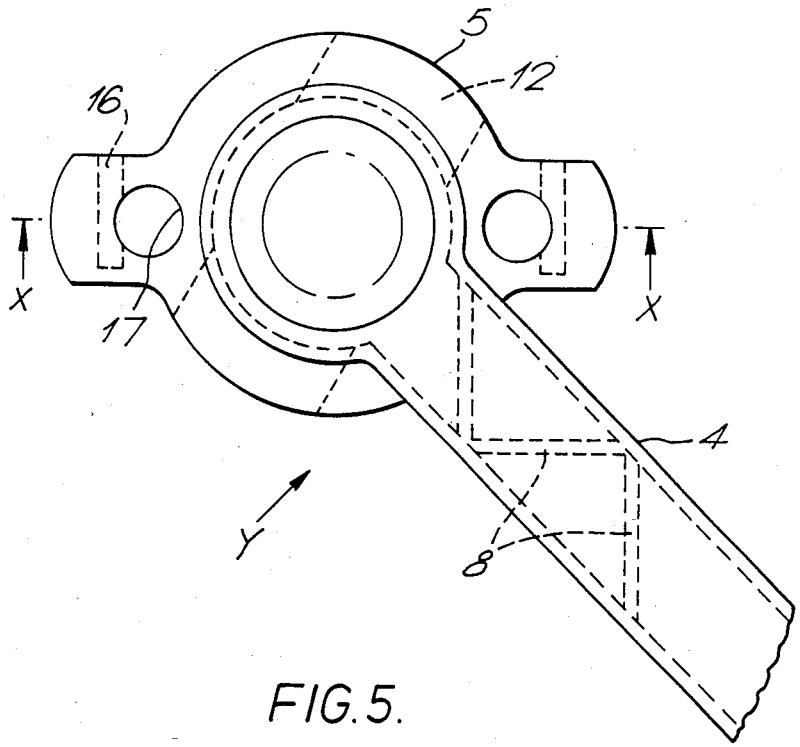
FIG. 5 is an outside side view of the right-hand ladder anchor of FIG. 1.
Figure 6:
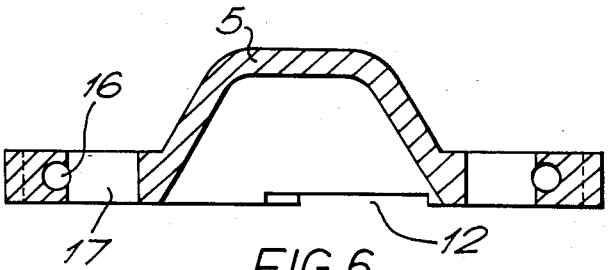
FIG. 6 is a cross-sectional view of the anchor of FIG. 5 through the plane X—X.
Figures 7, 8:
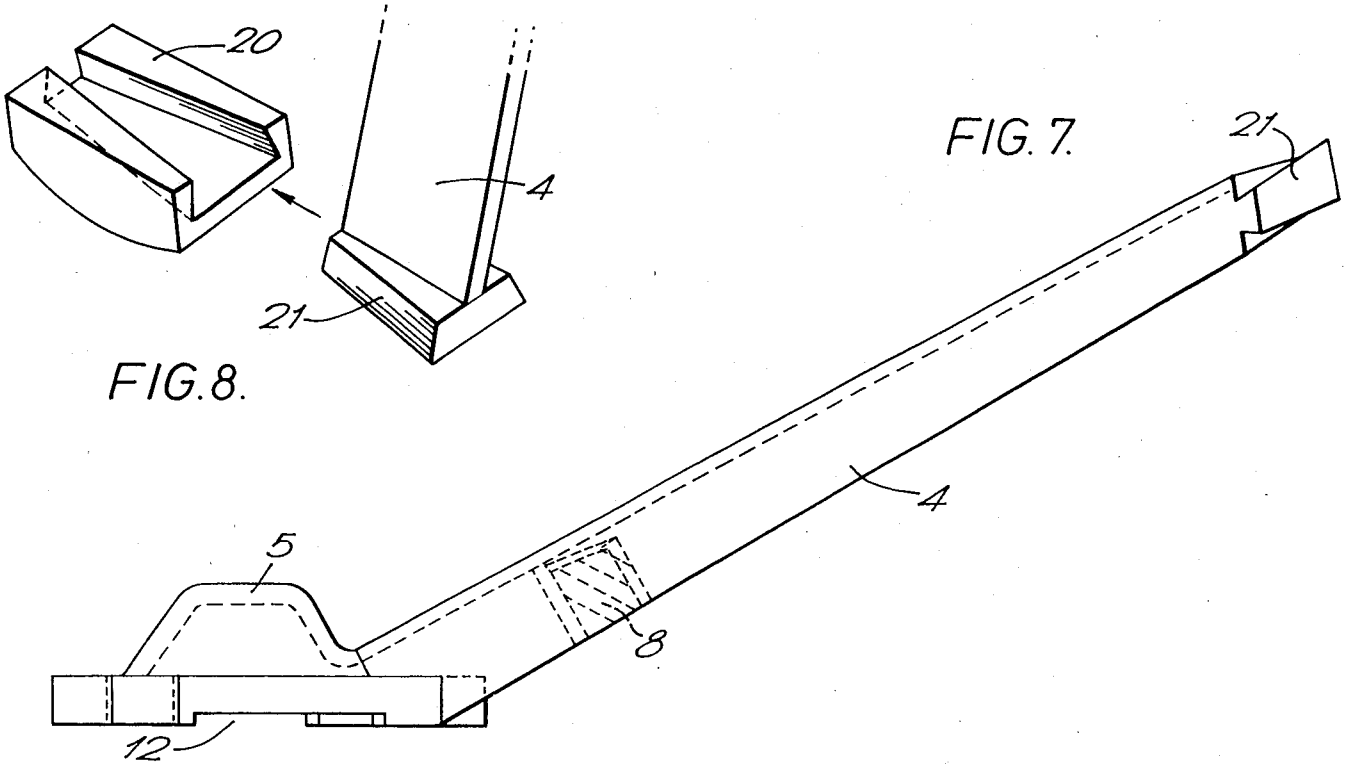
FIG. 7 is a perspective view of the anchor of FIG. 5 from the direction Y.
FIG. 8 is a perspective view of a preferred embodiment of a foot portion.

FIGS. 5, 6 and 7 show a right-hand stabiliser in greater detail. In a preferred embodiment the stabiliser leg 4 is provided with webbing 8 to provide greater strength. It may be seen that the attachment portion is formed generally as a hollow dome so that the face (visible in FIGS. 2 and 3) which engages the outer side face of the ladder stile is free of material in a central circular region.

FIG. 8 shows a rubber foot 20 which connects to a suitably dovetail- and wedge-shaped plate 21 fixed to the lower end of leg 4.

When it is desired to detach the device the clamping mechanism may be released to allow the pin heads to turn thereby releasing the ladder stile. It is unnecessary to release the device each time the ladder is moved: the device may remain attached to the ladder stile and simply readjusts itself when the ladder is repositioned. The adjustability of the device provides for simple fitting of a standard design of stabiliser to almost any size or shape of ladder.

Many modifications can be made to the device if desired: the leg portion may be tapered towards its free end if it is desired to fix it into soft ground. Alternatively, if it is preferred for the leg portion to rest on the surface of the ground, it may be thickened at its free end to provide a flat or serrated portion or pad, or an articulated foot could be provided.

We claim:

1. A stabiliser device for attachment to a stile of a ladder, said stabiliser device comprising an attachment portion adapted to be removably coupled to a stile of a ladder and a leg portion connected to and extending outwardly from the attachment portion to a surface engaging end, the attachment portion being provided with two pins extending outwardly therefrom, said pins each having an axis, said pin axes being generally parallel to one another, said pins being received in holes in said attachment portion so as to be axially moveable, said pins being positioned such that the stile can pass freely therebetween when the axis of the stile, the axes of the pins, and a line joining pin axes are generally mutually perpendicular, said pins being spaced such that they engage the respective edge faces of the stile when the stabiliser device is rotated about an axis generally parallel to the axes of the rungs of the ladder, said device further comprising means for clamping said pins into the desired axial position.

2. A device as claimed in claim 1 wherein each pin has a portion at its free end which extends in a direction generally perpendicular to its longitudinal axis to define a retaining means which can engage the inner side face of the stile to prevent the device from becoming detached during use.

3. A device as claimed in claim 2 wherein each pin has a cylindrical shaft which may be freely rotated about its longitudinal axis within the receiving hole prior to clamping, and which is provided at one end with an eccentric head.

4. A device as claimed in claim 1 wherein the clamping means comprises a pad bolt having a cutaway region which may engage with the pin and which engagement may be tightened by pulling the pad bolt in a direction generally perpendicular to the longitudinal axis of the pin and fastening said pad bolt in position.

5. A device as claimed in claim 2 wherein the clamping means comprises a pad bolt having a cutaway region which may engage with the pin and which engagement may be tightened by pulling the pad bolt in a direction generally perpendicular to the longitudinal axis of the pin and fastening said pad bolt in position.

6. A device as claimed in claim 3 wherein the clamping means comprises a pad bolt having a cutaway region which may engage with the pin and which engagement may be tightened by pulling the pad bolt in a direction generally perpendicular to the longitudinal axis of the pin and fastening said pad bolt in position.

7. A pair of devices as claimed in claim 1 for attachment to the respective stiles of a ladder, which devices are mirror images of each other.

8. A stabiliser device for attachment to a stile of a ladder, said stabiliser device comprising an attachment portion adapted to be removably coupled to a stile of a ladder and a leg portion connected to and extending outwardly from the attachment portion to a surface engaging end, the attachment portion being provided with two projections of adjustable length extending outwardly therefrom, said projections each having an axis, said projection axes being generally parallel to one another, said projections being positioned such that the stile can pass freely therebetween when the axis of the stile, the axes of the projections, and a line joining the projections are generally mutually perpendicular, the attachment portion further having a face which engages the outer side face of the stile, said attachment portion face being provided with a relieved channel, said projections being spaced such that they engage respective edge faces of the stile when the stabiliser device is rotated about an axis, which is generally parallel to the axes of the rungs of the ladder.

9. A device as claimed in claim 8 wherein the channel runs generally transversely to a line joining the two projections.

10. A device as claimed in claim 9 wherein the channel runs in a direction generally parallel to the axis of the ladder stile in use.

11. A device as claimed in claim 8 wherein the attachment portion is formed generally as a hollow dome so that there is no material at a central region of the first face of the attachment portion which engages the outer side face of the ladder stile in use.

12. A device as claimed in claim 8 wherein each projection has a portion at its free end which extends in a direction generally perpendicular to its longitudinal axis to define a retaining means which can engage the inner side face of the stile to prevent the device from becoming detached during use.

13. A device is claimed in claim 8 wherein each of said projections comprises and axially moveable pin received in a corresponding receiving hole in the attachment portion, and wherein said device further comprises means for clamping the pins into position.

* * * * *